US009435277B2

(12) United States Patent
Garrard et al.

(10) Patent No.: US 9,435,277 B2
(45) Date of Patent: Sep. 6, 2016

(54) METHOD OF CALIBRATING A CRANK ANGLE OF A COMBUSTION ENGINE

(71) Applicants: Michael Robert Garrard, Jaywick (GB); William E. Edwards, Ann Arbor, MI (US); Alistair Paul Robertson, Glasgow (GB)

(72) Inventors: Michael Robert Garrard, Jaywick (GB); William E. Edwards, Ann Arbor, MI (US); Alistair Paul Robertson, Glasgow (GB)

(73) Assignee: Freescale Semiconductor, Inc., Austin, TX (US)

( * ) Notice: Subject to any disclaimer, the term of this patent is extended or adjusted under 35 U.S.C. 154(b) by 288 days.

(21) Appl. No.: 14/445,139

(22) Filed: Jul. 29, 2014

(65) Prior Publication Data

US 2016/0032852 A1 Feb. 4, 2016

(51) Int. Cl.

| | |
|---|---|
| ***F02P 5/15*** | (2006.01) |
| ***F02D 41/00*** | (2006.01) |
| ***F02D 41/24*** | (2006.01) |
| ***F02D 35/02*** | (2006.01) |
| ***F02D 41/12*** | (2006.01) |
| *F02D 41/28* | (2006.01) |

(52) U.S. Cl.

CPC ..... *F02D 41/009* (2013.01); *F02D 35/023* (2013.01); *F02D 41/123* (2013.01); *F02D 41/2432* (2013.01); *F02D 41/2474* (2013.01); *F02P 5/151* (2013.01); *F02P 5/1504* (2013.01); *F02D 2041/281* (2013.01); *F02D 2200/021* (2013.01); *F02D 2200/101* (2013.01); *F02D 2250/24* (2013.01)

(58) Field of Classification Search

CPC ..... F02D 35/023; F02D 35/024; F02P 5/15; F02P 5/151; F02P 5/1504

USPC ..... 123/406.58, 406.59, 406.64, 435

See application file for complete search history.

(56) References Cited

U.S. PATENT DOCUMENTS

| | | | | |
|---|---|---|---|---|
| 4,531,399 | A * | 7/1985 | Aono | F02D 35/023 73/1.59 |
| 5,276,625 | A * | 1/1994 | Nakaniwa | F02D 35/023 123/406.22 |
| 7,669,584 | B2 | 3/2010 | Matekunas et al. | |
| 7,913,536 | B2 * | 3/2011 | Tiek | G01D 3/032 73/1.01 |
| 2003/0037767 | A1 * | 2/2003 | Breitegger | G01M 15/06 123/406.58 |
| 2005/0187700 | A1 * | 8/2005 | Jacobson | F02D 35/023 701/103 |

* cited by examiner

*Primary Examiner* — Erick Solis

(57) ABSTRACT

The present application provides a calibration device for calibrating a crank angle of a calibrateable combustion engine, the calibrateable combustion engine and a method for calibrating. The calibration device is provided to determine a trigger wheel angle offset from a combustionless driving of the combustion engine in that an in-cylinder pressure profile is recorded, on the basis of which a trigger wheel angle offset is determined and stored at an offset memory of the combustion engine. The combustion engine is configured to determine a crank angle on the basis of a measured trigger wheel angle and the stored trigger wheel angle offset.

18 Claims, 4 Drawing Sheets

METHOD OF CALIBRATING A CRANK ANGLE OF A COMBUSTION ENGINE

FIELD OF THE INVENTION

This invention relates to a method of calibrating a crank angle of a combustion engine.

BACKGROUND OF THE INVENTION

A combustion engine comprises one or more pistons for driving a crank shaft. The crank shaft converts the linear, e.g., up and down, movement of each piston into a rotational movement in which the crank shaft rotates about a crank shaft axis. Each piston has an end section situated inside a cylinder. The cylinder and the respective piston together form a combustion chamber. Fuel and air may be ignited in the combustion chamber to exert a force on the piston, thereby driving the piston. The mixture of air and fuel inside the combustion chamber needs to be ignited at an appropriate moment in each drive cycle of the piston. That is, the air fuel mixture in the cylinder should be ignited when the piston is at a certain position relative to the cylinder. The air fuel mixture may be ignited by generating a spark inside the combustion chamber. The spark may be generated for example by interrupting an electrical current through an induction coil. More specifically, it may be desirable to ignite the air fuel mixture when the piston is at a predefined fixed position, referred to herein as the ignition position, relative to its top dead centre (TDC) position. TDC is the position in which the volume of the combustion chamber is minimal. The TDC is one of the two turning points of the piston. Depending on the design of the engine, the optimal instant for triggering the spark may be shortly before or after the piston is at TDC In other words, the ignition position may be near the TDC. The instantaneous position or phase of the piston or, equivalently, of the crank shaft, may be determined, for example, using a trigger wheel.

An example of an engine 10 comprising a cylinder (not shown), a piston 12, and a crank shaft 16 is schematically shown in FIG. 1. The piston 12 is located inside the cylinder and delimits with the cylinder a combustion chamber, this being the volume above the piston and within the closed end of the cylinder. The piston 12 is capable of linear, e.g., up and down, movement when a mixture of air and fuel in the combustion chamber of the cylinder is ignited at suitable times, e.g., each time the piston 12 is approximately at its top dead centre. The piston 12, possibly in conjunction with one or more other pistons (not shown), is connected to the crank shaft 16 via the moveable conrod 14, and thus drives the crank shaft 16 to rotate about the crank shaft axis 18. One cycle of the piston 12, that is, the time it takes the piston 12 to complete one cycle of motion, e.g., from top dead centre to top dead centre, may translate into one revolution of the crank shaft.

The engine 10 may further comprise a trigger wheel 20 connected to the crank shaft 16 and which is rotatable with the crank shaft 16 about the crank shaft axis 18. The trigger wheel 20 may be connected rigidly to the crank shaft 16, or they may be formed in one piece. Accordingly, one revolution of the crank shaft 16 may result in one corresponding revolution of the trigger wheel 20. In another example (not shown) a trigger wheel comparable to the trigger wheel 20 may be connected to the crank shaft via a gear assembly. In this case, the trigger wheel may have a rotational cycle shorter or longer than the rotational cycle of the crank shaft. The trigger wheel 20 may have a circumference 22 which may be dented. For example, the circumference 22 of the trigger wheel 20 may exhibit an alternating series of teeth 24 and recessions 26.

The engine 10 may further comprise a trigger wheel sensor 28. The trigger wheel sensor may be arranged near the trigger wheel 20 so as to generate a trigger wheel signal in response to rotation of the trigger wheel 20. In the example, the trigger wheel sensor 28 comprises an induction sensor 30 configured to induce an electrical voltage in response to a magnetic flux which may be modulated by the motion of the trigger wheel 20. In the example, the trigger wheel sensor 30 comprises a core 32 comprising a ferromagnetic material. The trigger wheel 20 or the core 32 or both may be at least partly magnetic or a permanent magnet may be operably coupled to the core 32. A gap 34 between the core 32 and the trigger wheel 20 may be wider or narrower in dependence of the rotational position of the trigger wheel. More specifically, the gap 34 may be narrow when one of the teeth 24 is facing the core 32 and wider when one of the recessions 26 is facing the core 32. The trigger wheel sensor 30 may further comprise a coil 36. The coil 36 may have one or more loops around the core 32. An electrical voltage may thus be induced in the coil in accordance with the rotational motion of the trigger wheel 20. The coil 36 may have a differential output 38, 40 for providing the induced voltage.

In the example, the trigger wheel sensor 28 further comprises a comparator 42 having a differential input connected to the differential output 38, 40 of the coil 36. The comparator 42 may be incorporated into the sensor or implemented remotely in an electronic control unit, for example. The comparator 42 may be configured to produce an output potential in response to the voltage received from the differential output 38, 40 of the coil 36. The trigger wheel sensor 28 may thus generate a trigger wheel signal, e.g., the output potential from the comparator 42, in response to rotation of the trigger wheel 20. The comparator 42 may introduce a certain delay between the trigger wheel signal and the induced voltage at the differential output 38, 40. The trigger wheel signal may be fed to an ignition controller (e.g., the micro-controller unit 54 in FIG. 4) driving an ignition device (not shown) located near or inside the combustion chamber in the cylinder to ignite the air fuel mixture in the combustion chamber at times adapted to the position of the trigger wheel 20 and thus adapted to the motion of the piston 12. The ignition controller may be set so as to achieve an optimal timing of the ignition moment relative to the position of the piston 12.

FIG. 2 schematically shows the trigger wheel 20 and the induction sensor 30 from FIG. 1. Typically, the voltage induced by, e.g., the coil 36 in response to rotation of the trigger wheel 20, more specifically the passing of a tooth edge, has a certain phase lag relative to the trigger wheel's tooth edge passing the induction sensor. For example, the phase lag of the induced voltage should ideally be zero and the peak voltage should occur when the tooth edge is passing the induction sensor. As a consequence of the many geometrical tolerances and imperfections of the components between and including the trigger wheel 20 and the piston 12, the induced voltage from the coil 36 may have a phase lag relative to a detected tooth and thereby a phase lag relative to top dead centre position of the piston 12 which differs noticeably from the ideal value of zero. These combined errors may all contribute to a non-ideal phase lag between the actual position of the trigger wheel when the piston is at TDC and the indicated position of TDC from the trigger wheel itself, as illustrated schematically by the two sinusoidal graphs in the figure, wherein the plain graph refers to an ideal signal and the crossed graph refers to an observed signal from the induction sensor 30.

In other words, the accuracy of the trigger wheel angle as measured by the trigger wheel sensor 28 may be affected by manufacturing and other tolerances. Such tolerances may be the result of mechanical, electrical and magnetic effects. Mechanical tolerances may include, for example, tolerances of the trigger wheel teeth machining, the alignment of the trigger wheel relative to the crank shaft, the placement of bored holes, tolerances of the alignment of the induction sensor 30 relative to the trigger wheel 20, and clearances between bolts and bored holes. Electrical tolerances may for example include tolerances of a phase shift or delay of the trigger wheel sensor 28, as well as tolerances of the circuitry connected to the induction sensor 30.

The phase shift between the observed sensor signal (plain graph in FIG. 2) and the ideal signal (crossed graph in FIG. 2) may be the accumulated effect of various manufacturing tolerances. The phase shift may have a negative impact on the performance of the engine. Notably, the phase shift may cause the ignition spark to be triggered too early or too late. In engines in which fuel, e.g., gasoline, is injected directly into the cylinder at a suitable moment in each combustion cycle of the cylinder, both the timing of the spark and timing of the fuel injection may suffer from an imperfect phase shift of the output signal of the trigger wheel sensor. This phase shift is equivalent to an imperfect offset of the trigger wheel angles represented by the output signal of the trigger wheel sensor 28 and illustrated in FIG. 2. The most sensitive engines in this respect are, in order, engines using in-cylinder pressure control, diesel engines, and gasoline direct injection engines.

For example, combustion-generated pressure before TDC may slow the engine, whereas combustion-generated pressure after TDC may speed it up. The engine may therefore be quite sensitive to the timing of the ignition relative to the TDC, i.e., relative to the instant at which the piston is at the TDC. For example, FIG. 3 shows the pressure inside the combustion chamber, i.e., the in-cylinder pressure as a function of the crank angle in different scenarios. Graph A illustrates the in-cylinder pressure as a function of the crank angle in a scenario in which the piston is driven, e.g., by another engine, and no ignition is triggered, in order to show the pure pressure profile that may result from a variation of the volume of the combustion chamber alone. Graph B shows the in-cylinder pressure as a function of the crank angle in a scenario in which the ignition is retarded and the mechanical energy extracted is poor. Graph C refers to a scenario in which the ignition is timed correctly and thus although the combustion energy is the same as with Graph B, significantly greater mechanical energy is extracted. Graph D shows the in-cylinder pressure in a scenario in which the fuel air mixture is ignited too early, causing knock and thus potentially causing engine damage. Therefore the accurate knowledge of crank angle and timing of ignition is central to the efficient operation of an internal combustion engine.

In particular, some calculations of engine performance such as Indicated Mean Effective Pressure using data from an in-cylinder pressure sensor might be 10% out for an error in crank position of only 1 degree. Errors of even this magnitude might have a significant detrimental impact on the ability to control an engine using Homogeneous Charge Compression Ignition.

SUMMARY OF THE INVENTION

The present invention provides a method as described in the accompanying claims.

Specific embodiments of the invention are set forth in the dependent claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. Elements in the figures are illustrated for simplicity and clarity and have not necessarily been drawn to scale.

DETAILED DESCRIPTION OF THE PREFERRED EMBODIMENTS

Figure 4:
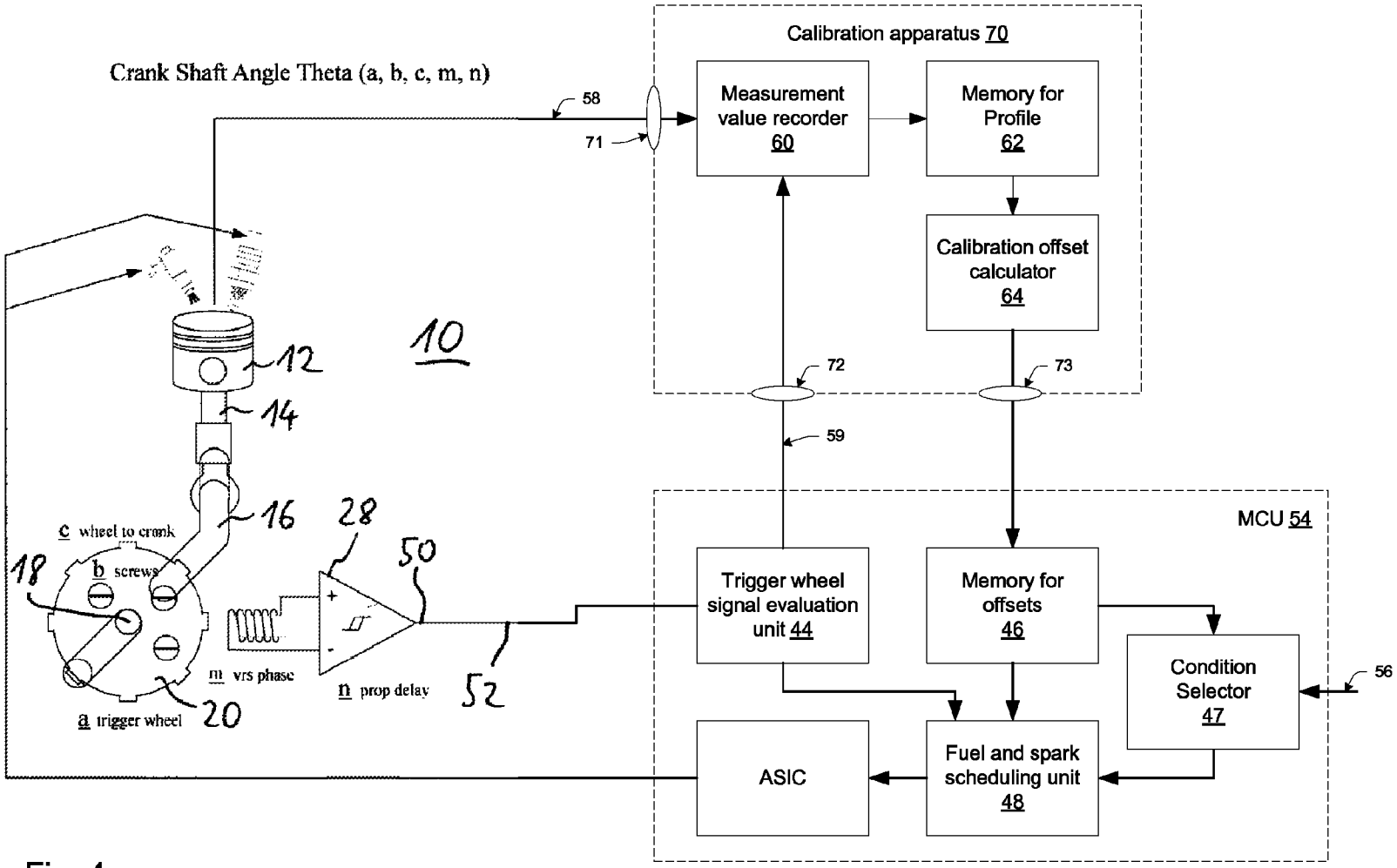
FIG. 4 schematically illustrates an example of an embodiment of a method of calibrating an engine.

Referring now to FIG. 4, an example of a method of calibrating a combustion engine is described. The combustion engine 10 may comprise a crank shaft 16, a piston 12, a trigger wheel 20, a trigger wheel sensor 28, a trigger wheel signal evaluation unit 44, an offset memory unit 46 and a fuel and spark scheduling unit 48. The crank shaft may be rotatable about a crank shaft axis 18. The piston 12 may be connected to the crank shaft 16 for driving the crank shaft. The trigger wheel 20 may be connected to the crank shaft 16 and arranged to rotate with the crank shaft 16. The trigger wheel sensor 28 may be arranged near the trigger wheel 20, for generating a trigger wheel signal in response to rotation of the trigger wheel 20. The trigger wheel signal may be provided at an output 50 of the trigger wheel sensor 28. The output 50 may be connected to an input 52 of the trigger wheel signal evaluation unit 44, for feeding the trigger wheel signal to the trigger wheel signal evaluation unit 44. In the example, the trigger wheel signal evaluation unit 44, the offset memory unit 46, and the fuel and spark scheduling unit 48 are arranged on a single chip, e.g., in a micro controller unit (MCU) 54. The trigger wheel signal evaluation unit 44 may be configured to determine a trigger wheel angle, which is a measure of the instantaneous angle of rotation of the trigger wheel 20, by evaluating the trigger wheel signal from the trigger wheel sensor 28. As explained above, the thus determined (measured) trigger wheel angle may have an imperfect offset relative to the correct trigger wheel angle.

The offset memory unit 46 may be configured to store a trigger wheel angle offset. The offset memory unit 46 may be a static random access memory (SRAM) unit or non-volatile memory such as flash or EEPROM, for example. The trigger wheel angle offset, or trigger wheel angle offsets for different operating conditions, or the current and previously determined trigger wheel angle offsets, may thus be stored statically, that is, without powering the memory unit 46. The trigger wheel angle offset may be used as a calibration parameter for correcting the measured trigger wheel angle, to generate a crank angle that has a smaller systematic error than the measured trigger wheel angle. The fuel and spark scheduling unit 48 may be configured to determine, e.g., compute, a crank angle, which is a measure of the instantaneous angle of rotation of the crank shaft 16, by correcting the measured trigger wheel angle on the basis of the trigger wheel angle offset. The trigger wheel angle offset may be added to or subtracted from the trigger wheel angle. The thus determined crank angle may be a more reliable indication of the instantaneous angle of rotation of the crank shaft than the measured trigger wheel angle determined by the trigger wheel signal evaluation unit 44. The trigger wheel angle offset may be determined with the help of a calibration device 70, for example, as follows.

Figure 1:
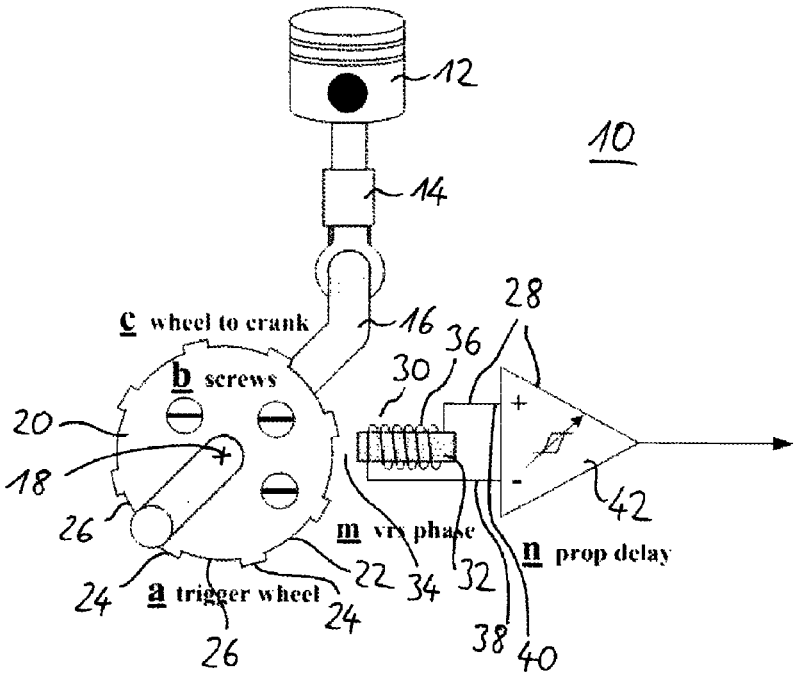
FIG. 1 schematically shows an example of an embodiment of an engine.
Figure 2:
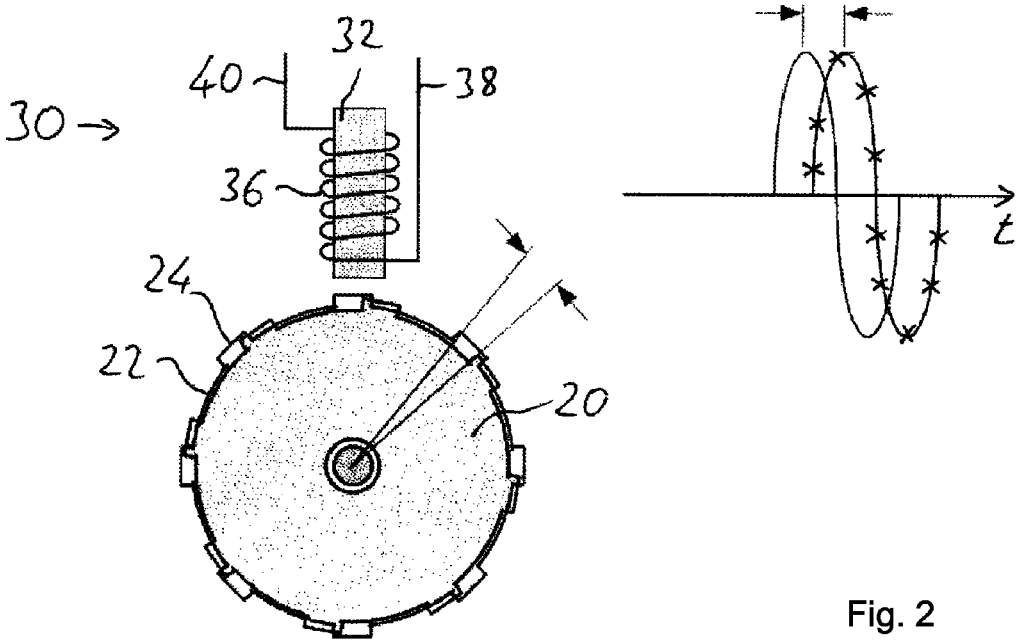
FIG. 2 schematically shows an example of an embodiment of an engine along with a diagram of a trigger wheel signal compared to an ideal trigger wheel signal.
Figure 3:
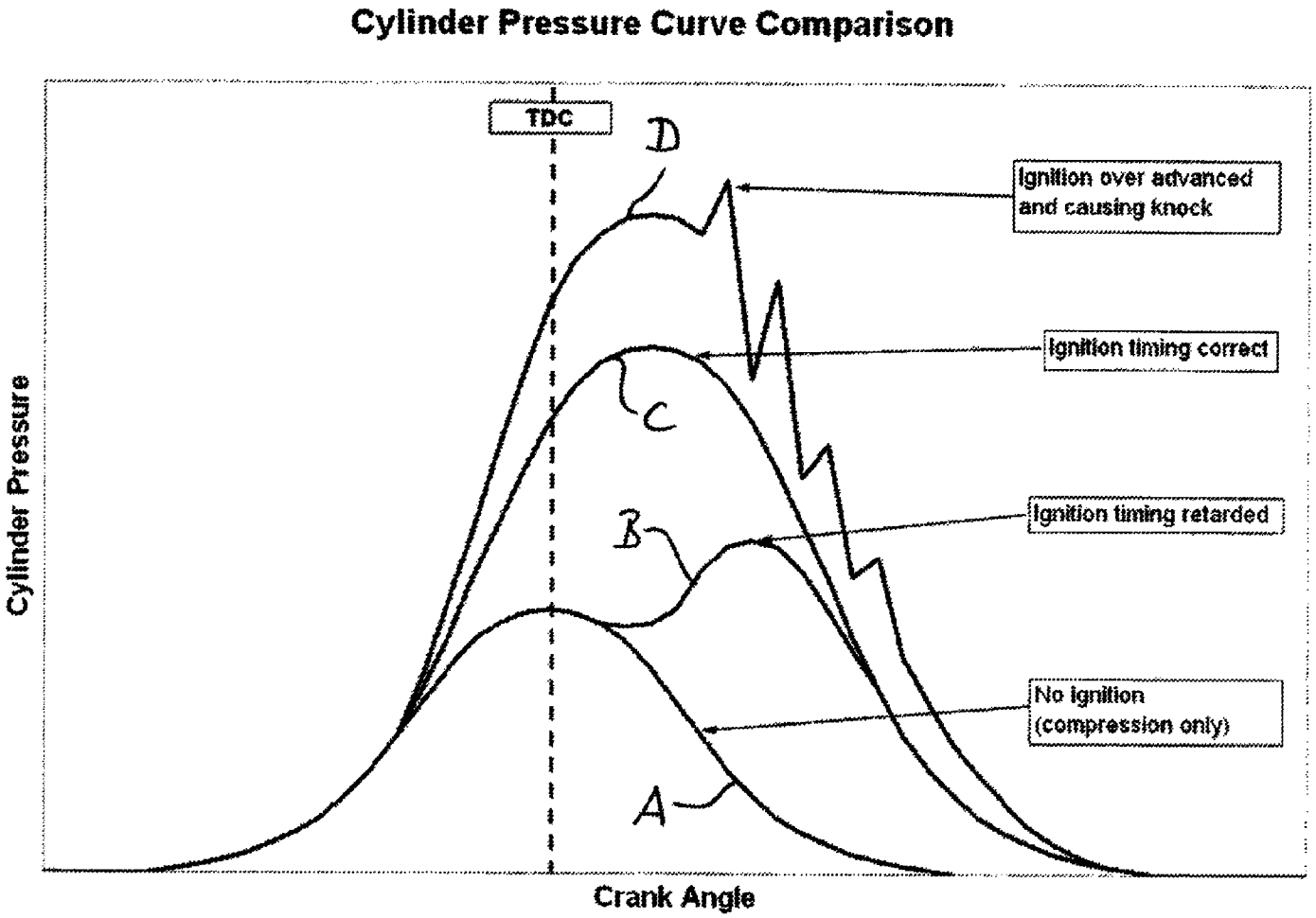
FIG. 3 shows a diagram illustrating examples of a pressure profile.

In order to determine the trigger wheel angle offset, the crank shaft 16 may be operated in a combustionless mode. That is, the crank shaft may be driven by, e.g., an external motor (not shown) which may be not part of the engine 10 and which may be connected temporarily to the crank shaft 16. In the combustionless mode, fuel injected into the combustion chambers of the cylinders of the combustion engine and/or generation of ignition sparks in the cylinders is suspended such that the pistons in the cylinders are driven into reciprocating action without combustion. The pressure inside the cylinder may thus vary in accordance with the movement of the piston 12. When the piston 12 is at TDC, the volume of the gas, e.g., air, inside the cylinder may be minimal and the in-cylinder pressure may accordingly be maximal, e.g., as illustrated qualitatively in graph A of FIG. 3 described above. The calibration device 70 is operatively connected through an input 72 to the trigger wheel evaluation unit 44. While the crank shaft 16 is being driven, trigger angle value signals 59 from the trigger wheel evaluation unit 44 are fed into a measurement value recorder 60 of the calibration device 70, which is configured to record the trigger angle values. At the same time, while the crank shaft 16 is being driven, the in-cylinder pressure is measured and in-cylinder pressure values, which are measured values of the in-cylinder pressure. The measurement value recorder 60 is configured to record the in-cylinder pressure values 58. The in-cylinder pressure values are measured by pressure sensors, which are configured to sense the pressure a cylinder of the combustion engine and to generate in-cylinder pressure value signals 59. The in-cylinder pressure value signals are fed into the calibration device 70 via an input 72. The recorded trigger angle values and in-cylinder pressure values may represent an in-cylinder pressure profile, which may be stored in a profile memory 62. Using the in-cylinder pressure profile, a measured trigger wheel angle which coincides with a top dead centre of a piston 12 may be determined. The top dead centre of a piston 12 is obtainable from the in-cylinder pressure profile, which shows a maximum of the measured in-cylinder pressure values when the piston (18) has adopted its top dead centre position (TDC). A calibration offset calculator 64 of the calibration device 70 is configured to determine the trigger wheel angle, at which the maximum of the measured in-cylinder pressure values is located. The measured in-cylinder pressure values may be considered as a function of the measured trigger wheel angle values. Determining the measured trigger wheel angle may include angle corrections to account for thermal losses. The thus determined trigger wheel angle may provided to be stored as the trigger wheel angle offset, e.g., in the offset memory unit 46.

Thus a reliable methodology for correcting or calibrating the output from the trigger wheel sensor 28 is provided. The instant at which the piston 12 (or, equivalently, the crank shaft 16) is at the top dead centre position can be inferred accurately from the in-cylinder pressure profile because the latter is not substantially affected by any manufacturing tolerances of the crank shaft and the trigger wheel. In order to obtain a very high accuracy of the trigger wheel angle offset, the above described in-cylinder pressure measurements may be performed under controlled operating conditions. Notably, due to the thermal losses mentioned above, it may be beneficial to place the engine 10 into a known state e.g., when the engine 10 is at operating temperature and at equilibrium with its environment. The calibration measurements may for example be performed at the end of the manufacturing process or during maintenance.

In one example, the engine 10 comprises an auxiliary motor (not shown) for driving the crank shaft in order to determine the trigger wheel angle offset. The engine 10 may for example be configured to determine the trigger wheel angle offset by the above-described pressure measurements, which may comprise driving the crank shaft and recording the in-cylinder pressure profile, automatically, for example, in a period in which there is no need for normal operation of the engine; for example, at the end of the manufacturing process.

The engine 10 may comprise one or more in-cylinder pressure sensors. Each in-cylinder pressure sensor is a pressure sensor located inside the cylinder. In an engine comprising more than one cylinder, each cylinder may have its own set of one or more in-cylinder pressure sensors. The in-cylinder pressure sensors may be particularly accurate when new and they may operate across the entire engine speed range.

Trigger wheel angle offsets may be determined by observing the pressure inside the cylinder for various operating parameters or operating conditions. The respective individual trigger wheel angle offsets may be stored in the trigger wheel angle offset memory unit 46. For example, for each engine speed value among a set of engine speed values, a corresponding set of one or more individual trigger wheel angle offset values may be determined. After the determination of more than one set of offset values, angle offsets for other operating points, e.g., different engine speeds may be interpolated or extrapolated from the stored set of offset values. During operation of the engine, the individual trigger wheel angle offset value of the set thereof may be selected depending on the current operating conditions and be used to determine a corresponding crank shaft angle, that is, a corrected (measured) trigger wheel angle. A condition selector 47 may be provided, which is configured to determine the individual trigger wheel angle offset value of the set thereof in dependence on at least one operating condition, which is fed into the condition selector 47. The condition selector 47 may be further configured to interpolate or extrapolate an individual trigger wheel angle offset value from one or more stored individual trigger wheel angle offset value being functions of one or more operating conditions.

Furthermore, the trigger wheel angle offset or the set of trigger wheel angle offsets may be newly determined when necessary, e.g., during maintenance or repair. Thus, a possible drift over time of the trigger wheel angle offset values in comparison to in-cylinder pressure may be detected. A time drift of the in-cylinder pressure values may be an indication that repair or maintenance measures may be required, e.g., re-bore, new rings, or a cylinder head overhaul, due to the time-invariant nature of positional accuracy of crank wheels and inductive sensors when compared to peak pressures.

Computations and scheduling for maintenance and repair may be based on various criteria. These criteria may include for example, a use/wear model and observing a drift of the in-cylinder pressure profile relative to the in-cylinder pressure profile at end of line. In one example, predictable errors are extrapolated to schedule repairs and recalibration.

It is noted that end of line and dealer determination of TDC used to be a standard practice with distributors. For example, techniques such as microwave measurements of the piston position within the combustion chamber and fly wheel timing marks may be used. Today, pressure sensing is notably used in dynamometers to accurately place the TDC. Offset corrections may be required to correct for variations of the engine temperature or gas leakages for example.

The technique described above is applicable to various engine types, including four-stroke internal combustion engines, two-stroke internal combustion engines, Wankel engines, and external combustion engines.

Figure 5:
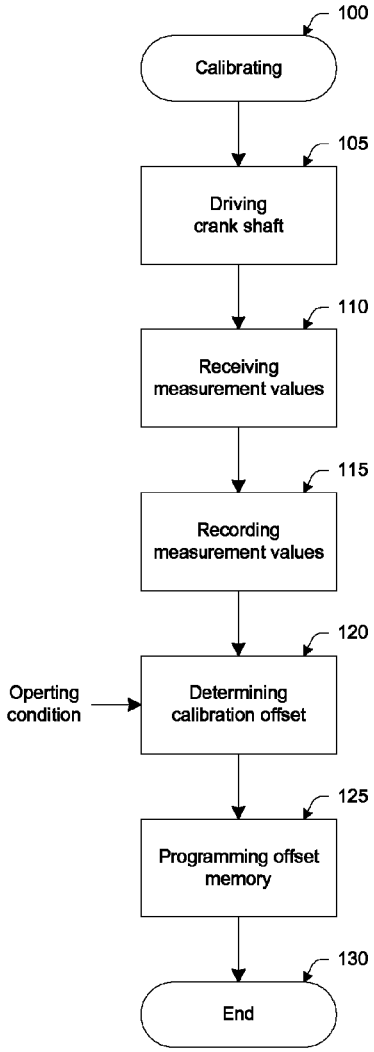
FIG. 5 shows a flow chart illustrating the operation of the exemplary calibration device in accordance with a particular embodiment of the present disclosure.

An exemplary calibration method for determining a trigger wheel angle offset will be further explained with reference to FIG. 5 showing a flow chart illustrating the operation (cf. 100) of the exemplary calibration device 70.

During combustionless driving (cf. 105) the crank shaft 16 of the combustion engine 10, the trigger angle values received (cf. 110) from the trigger wheel evaluation unit 44 and, at the same time, the in-cylinder pressure values received (cf. 110) from the one or more pressure sensors detecting the in-cylinder pressures are recorded (cf. 115) by the recorder 60. The recorded trigger angle values and the recorded in-cylinder pressure values represent an in-cylinder pressure profile, which may be stored at a profile memory 62.

On the basis of the stored in-cylinder pressure profile, a trigger wheel angle, which coincides with a maximum of the in-cylinder pressure, is determined (cf. 120) by the calibration offset calculator 64.

The determined trigger wheel angle is provided as the trigger wheel angle offset to be stored in an offset memory unit 46 of the combustion engine 10 (cf. 125). The trigger wheel angle offset enables the fuel and spark scheduling unit 48 of the combustion engine 10 to determine a crank angle, which is a measure of the instantaneous angle of rotation of the crank shaft of the combustion engine 10, by correcting the measured trigger wheel angle on the basis of the stored trigger wheel angle offset.

The calibration device 70 is further configured to receive one or more operating conditions. Each operating condition may comprise one or more condition parameters. A condition parameter may include at least one of an engine speed, a temperature of the combustion engine 10 and a temperature of an environment of the combustion engine 10. Individual trigger wheel angle offsets may be determined for different operating conditions. A set of individual trigger wheel angle offsets may be considered as a function of the condition parameters specifying the operating condition. The determining of individual trigger wheel angle offsets may require several calibration runs. In each calibration run an individual trigger wheel angle offset is determined for an operating condition specified on the basis of one or more condition parameters.

In order to determine the trigger wheel angle, which coincides with the maximum of the in-cylinder pressure, the calibration offset calculator 64 is further configured to interpolate the in-cylinder pressure profile with respect to the measured trigger wheel angle. The calibration offset calculator 64 may be configured to select, among the recorded trigger wheel angles, the one or more recorded trigger wheel angles, which have the highest measured in-cylinder pressure associated with them; and to select or interpolate between the selected trigger wheel angles to determine the trigger wheel angle, which coincides with the maximum of the in-cylinder pressure.

Figure 6:
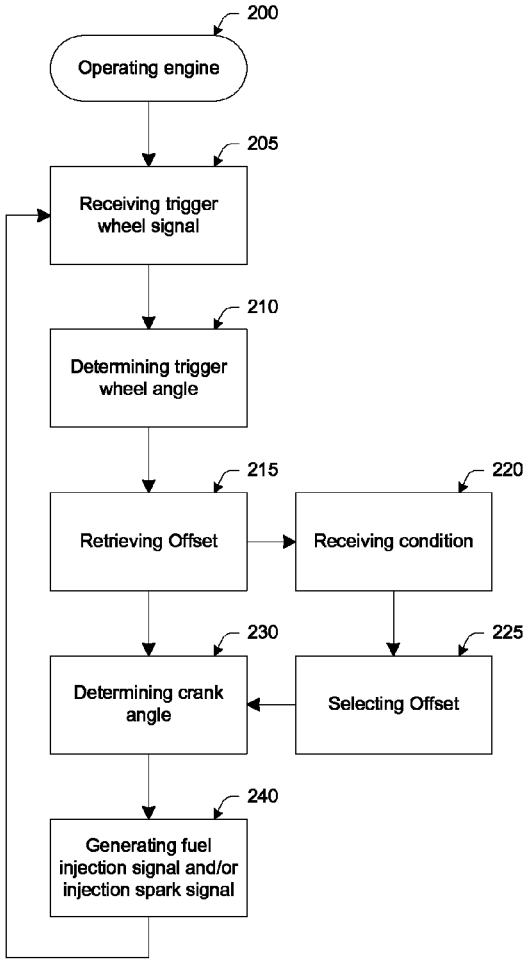
FIG. 6 shows a flow chart illustrating the operation of a exemplary calibrateable combustion engine in accordance with a particular embodiment of the present disclosure.

An exemplary operation method for of an exemplary calibrateable combustion engine will be further explained with reference to FIG. 6 showing a flow chart illustrating the operation (cf. 200) of the exemplary calibrateable combustion engine 10.

The calibrateable combustion engine 10 comprises a crank shaft 16, which is rotatable about a crank shaft axis 18; a cylinder 12 connected to the crank shaft 16, for driving the crank shaft; a trigger wheel 20 connected to the crank shaft 16 and arranged to rotate with the crank shaft 16; a trigger wheel sensor 28 arranged near the trigger wheel, configured to generate a trigger wheel signal in response to rotation of the trigger wheel; a trigger wheel signal evaluation unit 44 having an input connected to the trigger wheel sensor and configured to determine a measured trigger wheel angle, which is a measure of the instantaneous angle of rotation of the trigger wheel, by evaluating the trigger wheel angle signal; an offset memory unit 46 configured to store a trigger wheel angle offset; and a fuel and spark scheduling unit 48 configured to determine a crank angle, which is a measure of the instantaneous angle of rotation of the crank shaft, by correcting the measured trigger wheel angle on the basis of the trigger wheel angle offset. The trigger wheel angle offset is determined from an in-cylinder pressure profile, which is a representation of trigger angle values and in-cylinder pressure values, which are sensed at the same time while the combustion engine is driven combustionless.

During operation of the combustion engine 10 (cf. 200), the trigger wheel signal 50 generated by the trigger wheel sensor 20 is received (cf. 205) and the measured trigger wheel angle is determined (cf. 210) from the trigger wheel signal 50. The trigger wheel angle offset stored at the offset memory 46 is retrieved (215) and the actual crank angle is determined from the determined trigger wheel angle and the trigger wheel angle offset in that the trigger wheel angle offset is applied to correct the determined (measured) trigger wheel angle thereby obtaining a offset corrected crank angle, which substantially corresponds to the actual crank angle.

A spark plug for generating a spark inside the cylinder 12 may be connected to the fuel and spark scheduling unit 48, which is further configured to trigger the spark plug in accordance with the offset corrected crank angle. A fuel injection device plug for injecting an amount of fuel into the cylinder 12 may be connected to the fuel and spark scheduling unit 48, which is further configured to trigger the fuel injection device plug in accordance with the offset corrected crank angle.

The trigger wheel angle offset may comprise several individual trigger wheel angle offsets for different operating conditions. The individual trigger wheel angle offsets are stored at the offset memory 46. An operating condition may be specified on the basis of one or more condition parameters, which are for instance received by the condition selector 47 (cf. 220). It should be noted that the condition selector 47 may be part of the fuel and spark scheduling unit 48. On the basis of a current operating condition of the combustion engine 10 one of the individual trigger wheel angle offsets stored in the offset memory unit 46 is selected (cf. 225) in dependence of the current operation condition.

The fuel and spark scheduling unit 48 determined the offset corrected crank angle by correcting the measured trigger wheel angle on the basis of the selected individual trigger wheel angle offset.

The combustion engine may comprise a micro-controller unit, MCU 54, which comprises at least the trigger wheel signal evaluation unit 44, the offset memory unit 46, and the fuel and spark scheduling unit 48. A system for calibrating a crank angle of a combustion engine 10 comprising a calibrateable combustion engine and a calibration device according to examples of the present application as described above.

The invention may also be implemented in a computer program for running on a computer system, at least including code portions for performing steps of a method according to the invention when run on a programmable apparatus, such as a computer system or enabling a programmable apparatus to perform functions of a device or system according to the invention.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on computer readable storage medium or transmitted to the computer system via a computer readable transmission medium. All or some of the computer program may be provided on computer readable media permanently, removably or remotely coupled to an information processing system. The computer readable media may include, for example and without limitation, any number of the following: magnetic storage media including disk and tape storage media; optical storage media such as compact disk media (e.g., CD-ROM, CD-R, etc.) and digital video disk storage media; nonvolatile memory storage media including semiconductor-based memory units such as FLASH memory, EEPROM, EPROM, ROM; ferromagnetic digital memories; MRAM; volatile storage media including registers, buffers or caches, main memory, RAM, etc.; and data transmission media including computer networks, point-to-point telecommunication equipment, and carrier wave transmission media, just to name a few.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

In the foregoing specification, the invention has been described with reference to specific examples of embodiments of the invention. It will, however, be evident that various modifications and changes may be made therein without departing from the broader spirit and scope of the invention as set forth in the appended claims.

The terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, a plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality. For example, the MCU 54 may comprise a processor core and the units 44, 46, and 48 may be implemented in a program arranged to be executed by the processor core.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermediary components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. For example, the units 44, 46, and 48 may be arranged within the MCU 54. Alternatively, the examples may be implemented as any number of separate integrated circuits or separate devices interconnected with each other in a suitable manner.

For example, the units 42, 44, 46, and 48 may be implemented as separate, interconnected circuits.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The invention claimed is:

1. A calibration device for calibrating a crank angle of a combustion engine, wherein the calibration device is operatively connectable to a trigger wheel signal evaluation unit of the combustion engine for receiving trigger wheel angles and to one or more pressure sensors of the combustion engine for receiving in-cylinder pressure values, wherein the trigger wheel signal evaluation unit is operatively connected to a trigger wheel sensor and configured to determine a trigger wheel angle, which is a measure of the instantaneous angle of rotation of a trigger wheel, by evaluating the trigger wheel signal, wherein the trigger wheel is connected to and arranged to rotate with a crank shaft of the combustion engine, wherein the at least one pressure sensor is an in-cylinder pressure sensor, which is configured to measure pressures inside a cylinder of the combustion engine and to generate in-cylinder pressure values, wherein the calibration device comprises a recorder configured to record the trigger angle values received from the trigger wheel evaluation unit, and, at the same time, the in-cylinder pressure values received from the pressure sensor while the crank shaft of the combustion engine while the combustion engine is driven combustionless, wherein the recorded trigger angle values and the recorded in-cylinder pressure values represent an in-cylinder pressure profile; and a offset calculator configured to determine, on the basis of the in-cylinder pressure profile, a trigger wheel angle, which coincides with a maximum of the in-cylinder pressure; and wherein said calibration device is further configured to provide the determined trigger wheel angle as the trigger wheel angle offset to be stored in an offset memory unit of the combustion engine, wherein the trigger wheel angle offset enables a fuel and spark scheduling unit of the combustion engine to determine a crank angle, which is a measure of the instantaneous angle of rotation of the crank shaft of the combustion engine, by correcting the measured trigger wheel angle on the basis of the stored trigger wheel angle offset.

2. The calibration device of claim 1 further configured to determine several individual trigger wheel angle offsets each for a different operating condition of the combustion engine.

3. The calibration device of claim 2, wherein each different operating condition comprises one or more condition parameters, which include at least one of an engine speed, a temperature of the combustion engine and a temperature of an environment of the combustion engine.

4. The calibration device of claim 1, wherein the calibration offset calculator is further configured to interpolate the in-cylinder pressure profile to determine the trigger wheel angle, which coincides with the maximum of the in-cylinder pressure.

5. The calibration device of claim 1, wherein the calibration offset calculator is further configured to select, among the recorded trigger wheel angles, the one or more trigger wheel angles, which have the highest measured in-cylinder pressure associated with them; and to at least one of select and interpolate between the selected trigger wheel angles to determine the trigger wheel angle, which coincides with the maximum of the in-cylinder pressure.

6. A calibrateable combustion engine comprising:

a crank shaft, which is rotatable about a crank shaft axis;

a cylinder connected to the crank shaft, for driving the crank shaft;

a trigger wheel connected to the crank shaft and arranged to rotate with the crank shaft;

a trigger wheel sensor arranged near the trigger wheel, configured to generate a trigger wheel signal in response to rotation of the trigger wheel;

a trigger wheel signal evaluation unit having an input connected to the trigger wheel sensor and configured to determine a trigger wheel angle, which is a measure of the instantaneous angle of rotation of the trigger wheel, by evaluating the trigger wheel signal;

an offset memory unit configured to store a trigger wheel angle offset; and a fuel and spark scheduling unit configured to determine a crank angle, which is a measure of the instantaneous angle of rotation of the crank shaft, by correcting the measured trigger wheel angle on the basis of the trigger wheel angle offset, wherein the trigger wheel angle offset is determined from an in-cylinder pressure profile, which is a representation of trigger angle values and in-cylinder pressure values, which are sensed at the same time while the combustion engine is driven combustionless.

7. The combustion engine of claim 6 further comprising a spark plug for generating a spark inside the cylinder, which is connected to the fuel and spark scheduling unit, wherein the fuel and spark scheduling unit is further configured to trigger the spark plug in accordance with the crank angle determined by the fuel and spark scheduling unit.

8. The combustion engine of claim 6, further comprising a fuel injection device plug for injecting an amount of fuel into the cylinder, which is connected to the fuel and spark scheduling unit, wherein fuel and spark scheduling unit is further configured to trigger the fuel injection device plug in accordance with the crank angle determined by the fuel and spark scheduling unit.

9. The combustion engine of claim 6, wherein the trigger wheel angle offset comprises several individual trigger wheel angle offsets for different operating conditions, wherein the fuel and spark scheduling unit is further configured to receive a current operating condition of the combustion engine;

to select one of the individual trigger wheel angle offsets stored in the offset memory unit in dependence of the current operation condition; and to determine the crank angle by correcting the trigger wheel angle on the basis of the selected individual trigger wheel angle offset.

10. The combustion engine of claim 6, wherein each of the operating conditions comprises one or more temperatures, wherein the one or more temperatures include at least one of a temperature of the combustion engine and a temperature of an environment of the combustion engine.

11. The combustion engine of claim 6, wherein the combustion engine comprises a micro-controller unit, MCU, which comprises at least the trigger wheel signal evaluation unit, the offset memory unit, and the fuel and spark scheduling unit.

12. A method of calibrating a crank angle of a combustion engine, wherein the combustion engine comprises:

a crank shaft which is rotatable about a crank shaft axis;

a cylinder connected to the crank shaft, for driving the crank shaft;

a trigger wheel connected to the crank shaft and arranged to rotate with the crank shaft;

a trigger wheel sensor arranged near the trigger wheel for generating a trigger wheel signal in response to rotation of the trigger wheel;

a trigger wheel signal evaluation unit having an input connected to the trigger wheel sensor and configured to determine a trigger wheel angle, which is a measure of the instantaneous angle of rotation of the trigger wheel, by evaluating the trigger wheel signal;

an offset memory unit configured to store a trigger wheel angle offset; and a fuel and spark scheduling unit configured to for determine a crank angle, which is a measure of the instantaneous angle of rotation of the crank shaft, by correcting the measured trigger wheel angle on the basis of the trigger wheel angle offset;

wherein the method comprises:

while the crank shaft is driven combustionless, recording trigger angle values received from the trigger wheel evaluation unit, and, at the same time, and recording in-cylinder pressure values received from a pressure sensor, which is configured to measure a pressure in the cylinder of the combustion engine and to generate the in-cylinder pressure values, wherein the recorded trigger angle values and the recorded in-cylinder pressure values represent an in-cylinder pressure profile;

determining, on the basis of the in-cylinder pressure profile, a trigger wheel angle which coincides with a maximum of the in-cylinder pressure; and providing the determined trigger wheel angle as the trigger wheel angle offset to be stored in the offset memory unit.

13. The method of claim 12, wherein the combustion engine comprises a spark plug for generating a spark inside the cylinder, which is connected to the fuel and spark scheduling unit, wherein the fuel and spark scheduling unit is configured to trigger the spark plug in accordance with the crank angle determined by the fuel and spark scheduling unit.

14. The method of claim 12, wherein the combustion engine comprises a fuel injection device plug for injecting an amount of fuel into the cylinder, which is connected to the fuel and spark scheduling unit, wherein the fuel and spark scheduling unit is configured to trigger the fuel injection device plug in accordance with the crank angle determined by the fuel and spark scheduling unit.

15. The method of claim 12, comprising:

determining several individual trigger wheel angle offsets each for a different operating condition; and storing the individual trigger wheel angle offsets in the offset memory unit.

16. The method of claim 15, comprising:

determining a current operating condition;

selecting one of the individual trigger wheel angle offsets stored in the offset memory unit in dependence of the current operation condition; and providing the selected individual trigger wheel angle offset to the fuel and spark scheduling unit.

17. The method of claim 12, wherein the determining of the trigger wheel angle, which coincides with the maximum of the in-cylinder pressure, comprises:

interpolating the in-cylinder pressure profile.

18. The method of claim 12, wherein the determining of the trigger wheel angle which coincides with the maximum of the in-cylinder pressure comprises:

selecting, among the recorded trigger wheel angles, the one or more trigger wheel angles which have the highest measured in-cylinder pressure associated with them; and at least one of selecting and interpolating between the thus selected trigger wheel angles.

* * * * *